United States Patent [19]

van Wersch

[11] 4,046,942

[45] Sept. 6, 1977

[54] METHOD OF PRODUCING AN ENDLESS FOLLOWER, AND PRODUCT PER SE

[75] Inventor: Kurt van Wersch, Wegberg, Germany

[73] Assignee: A. Monforts, Monchengladbach, Germany

[21] Appl. No.: 528,331

[22] Filed: Nov. 29, 1974

[30] Foreign Application Priority Data

Nov. 28, 1973 Germany ..... 2359170

[51] Int. Cl.[2] ..... B29D 27/04; B32B 7/00

[52] U.S. Cl. ..... 428/255; 29/131; 68/202; 68/204; 264/46.7; 264/46.9; 264/49; 264/54; 264/139; 264/259; 264/DIG. 5; 264/DIG. 13; 428/262; 428/311

[58] Field of Search ..... 264/46.9, DIG. 14, 259, 264/DIG. 5, DIG. 13, 50, 49, 46.7, 54; 68/202, 204; 29/132, 131; 428/255, 262, 311

[56] References Cited

U.S. PATENT DOCUMENTS

| | | | |
|---|---|---|---|
| 2,219,663 | 10/1940 | Schuster | 68/202 X |
| 2,327,001 | 8/1943 | Schott | 264/DIG. 14 |
| 2,384,387 | 9/1945 | Meyer | 264/DIG. 14 |
| 2,490,178 | 12/1949 | Van Der Kroon | 264/DIG. 14 |
| 2,609,347 | 9/1952 | Wilson | 264/48 X |
| 2,668,153 | 2/1954 | Hammon | 260/73 L X |
| 2,778,093 | 1/1957 | Mack | 29/131 X |
| 2,825,747 | 3/1958 | Rogers et al. | 260/2.5 R X |
| 3,012,283 | 12/1961 | Foster | 264/DIG. 14 |
| 3,087,201 | 4/1963 | Williams et al. | 264/257 |
| 3,289,703 | 12/1966 | Brown | 264/46.9 |
| 3,398,218 | 8/1968 | Richmond | 264/46.9 |
| 3,617,593 | 11/1971 | Alderfer | 264/257 |
| 3,619,446 | 11/1971 | Nauta | 264/312 |
| 3,714,308 | 1/1973 | Nettesheim | 264/46.9 |
| 3,932,905 | 1/1976 | Houben | 68/204 X |

FOREIGN PATENT DOCUMENTS

| | | | |
|---|---|---|---|
| 1,460,217 | 12/1968 | Germany | 68/202 |
| 39-3322 | 3/1964 | Japan | 68/204 |
| 433,173 | 9/1967 | Switzerland | 68/202 |
| 1,188,573 | 4/1970 | United Kingdom | 264/DIG. 14 |
| 446,506 | 4/1936 | United Kingdom | 29/131 |
| 494,610 | 10/1938 | United Kingdom | 68/202 |
| 700,746 | 12/1953 | United Kingdom | 29/131 |

OTHER PUBLICATIONS

Brydson, J. A. "Plastics Materials," Princeton, N. J., D. van Nostrand, c1966, pp. 224–228.

*Primary Examiner*—Philip Anderson
*Attorney, Agent, or Firm*—Herbert L. Lerner

[57] ABSTRACT

Method of producing an entrainer for squeezing or dyeing textile fabric webs with the aid of a foulard which includes inserting a spread-out endless textile web into an annular mold both the web and the annular mold having a periphery and a width corresponding to the periphery and width of the entrainer to be formed and thereafter filling the annular mold with a material that hardens to form a sponge; and endless entrainer produced by the foregoing method.

4 Claims, 7 Drawing Figures

METHOD OF PRODUCING AN ENDLESS FOLLOWER, AND PRODUCT PER SE

Figure 1A:
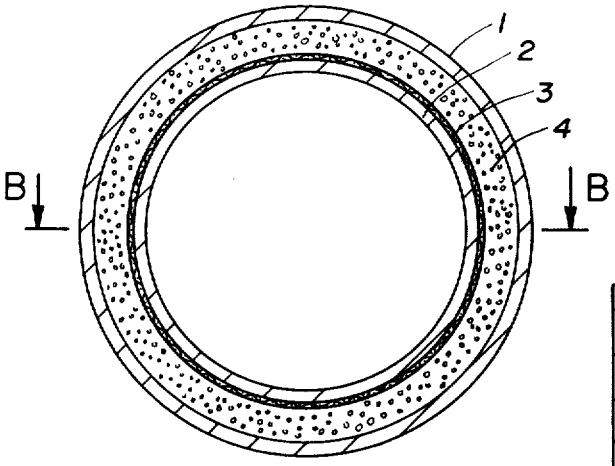

The invention relates to a method of producing a follower or entrainer for squeezing or dyeing textile fabric webs with the aid of a foulard. The invention furthermore relates to an endless entrainer per se as well as to the application of a sponge as entrainer in a foulard.

Such entrainers are, for example, advantageously utilizable during drying especially thermosolizing of a relatively voluminous textile fabric web. This process serves to develop or fix the dye in a continuous operation. For example, dispersion dyes, anionic or cationic dyes for dyeing polyester, polyamide, polyacrylnitrile or similar fibers or mixtures thereof are developed and/or fixed on the fabric web in an autoclave or in a thermal chamber. These processes require a draining or drying of the fabric web after the respective dye liquor has been applied.

Basically, three drying stages can be distinguished (note Krischer and Kroell, Drying Technology, Springer Publishing, Co., 1956, pages 233 ff). The first drying stage begins at a high moisture content. The rate of evaporation at the surface, where in this phase saturated vapor pressure and cooling limiting temperature always prevails, remains approximately constant, and consequently the drying speed is likewise constant. This drying step, during which the surface water is removed, is maintained for a period of time until the capillary liquid transport from the interior to the surface becomes smaller than the quantity of water that has evaporated per unit time till then. In that breaking point or inflexion in the course of the drying step, the liquid content in the surface becomes zero. When the drying speed decreases, the evaporation does not then occur any longer at the surface but rather in the interior of the fabric web, namely essentially within the capillaries thereof. The greatest part of this second drying stage wherein the capillary water is essentially withdrawn has generally, in the drying of textile fabric webs, received the designation "final drying", because a third drying stage, wherein molecular water could be removed, is not of interest there.

To drain or dewater textile fabric webs, squeeze foulards, suction devices, banks of infra-red heating lamps or the like are employed individually or in combination. For this so-called pre-drying, the first aforementioned drying stage must be gone through i.e., approximately the aforementioned inflexion point in the course of the drying stage wherein the liquid in the surface becomes zero must be attained or exceeded, because otherwise during "final drying" in the second drying stage in the succeeding machine (contact or convection drying) an undesired migration of the dye may occur respectively, in the initially dried region of the fabric web.

Furthermore, when surface water is present, a staining of the guide members of the machine can occur.

Since one can remove the greatest part of the moisture originating from immersion of the fabric web in the dye liquor by squeezing it out of the fabric web, and thereby attain a uniform application of moisture over the width thereof, the web is passed through a squeeze foulard generally directly after leaving the dye vat. If economical operation is desired, the fabric web must be squeezed to about 60% moisture with respect to the dry weight of the fabric. If this is not successful, the starting moisture required for the dye developing or fixing process can, in fact, be attained by over-dimensioning a succeeding infra-red channel, which necessitates, however, excessively high expenditures of energy in the infra-red channel so that the entire process can become profitable.

Numerous types of textile fabric webs are known, however, which cannot be drained or dewatered adequately with conventional squeeze foulards. In these categories are all kinds of relief-type mesh fabrics, cloth of texturized yarns especially thick, tufted or voluminous fabric webs or the like. Such cloths or webs do not permit themselves either to be squeezed to the desired extent at all or at least become considerably damaged due to the great pressure applied on respective lines in the squeeze foulard. Basically, if a dye migration from the inner region to the outer region of the fabric web, during final drying in hot flues, tenter frames and the like, is to be avoided, moisture values, such as $< 30\%$ water content for cotton fibers, $< 40\%$ water content for rayon fibers, and $< 1\%$ water content for polyester fibers, for example, must also be attained before the final drying for such goods. For these water contents, the dye developing or fixing is capable of being effected in itself by vaporization, or contact drying or convection drying. At any rate, the moisture content in part is so high yet that guide members can be marked up on the fabric web. One is therefore inclined, during the predrying phase, to drain or dewater even further than would be absolutely necessary for limiting the migration alone.

A process has been proposed heretofore in German Published Non-Prosecuted Application DT-OS No. 2,342,128, in which the foregoing requirements are capable of being readily fulfilled even for very voluminous and/or relief-type patterned fabric webs or webs of texturized yarns.

In this heretofore known process, while using a dye liquor with a high dye concentration corresponding to the extent of drainage or dewatering effected during the squeezing operation, the fabric web is passed between two absorbent, endless entrainers through a squeeze foulard. The entrainers are furthermore continuously saturated with the dye liquor before they come into contact with the fabric web. Thereafter, the fabric web, that has been squeezed to a moisture content of less than 40% with respect to the dry weight of the fabric, is dried to a final moisture content of at most 5% in an infra-red channel adjusted to relatively low drying speed to avoid cloud formation. Finally, depending upon the type of dyeing process, the fabric web is steamed for the purpose of developing the dye or is fixed during thermosolizing, essentially without width-stressing, at a high temperature that is actually yet permissable for the fibers, to increase the diffusion speed of the dye in the fibers.

In the foregoing heretofore known process, by using a squeeze foulard with two endless entrainers, the fabric web is given the identical treatment at both sides thereof. Thus, in the treatment, no difference in the dyeing between the right and the left sides of the fabric web exists. In contrast thereto, solely for draining or dewatering, one entrainer would supply virtually the same effect as both entrainers employed in the aforementioned process. The continuous saturation of the entrainers with dye liquor is also advantageous. This saturation can be effected advantageously by spraying the entrainers from the rear. Through the use of two entrainers, not only is a uniform dyeing of both sides of the fabric web attained but also, due to the sponge effect in the nip between the rollers of the squeeze foulard, an intimate distribution of the dye in the fabric web is achieved i.e., the fabric web is then provided completely uniformly with dye.

As is apparent from the foregoing, endless entrainers having considerable absorptive strength are used for the heretofore known aforedescribed process. Conventionally produced endless entrainers of woven or knitted fabric are therefore excluded among other reasons because of the large pores formed therein. Consequently, entrainers of essentially absorbent material, such as fleece, have been used in the heretofore known process. Such entrainers are not capable of being made endless, however, at least not in an economical manner. The danger always arose, therefore, primarily in their use for dyeing, especially thermosolizing, that the location of the seams or joints of the entrainers would become marked on the fabric webs being processed.

It is accordingly an object of the invention to provide an endless entrainer that has from the start no seams or joints but is nevertheless so absorbent and so durable or resistant to wear as to be utilizable in the forementioned process.

It is a further object of the invention to provide a method of producing such an endless entrainer that avoids the foregoing disadvantages of the heretofore known methods of this general and which is moreover, capable of economically producing an endless entrainer that is suitably absorbent.

With the foregoing and other objects in view, there is provided in accordance with the invention, a method of producing an entrainer for squeezing or dyeing textile fabric with the aid of a foulard which comprises inserting a spread-out or expensible endless textile web into an annular mold, both the web and the annular mold having a periphery and a width corresponding to the periphery and the width of the entrainer to be formed, and thereafter filling the annular mold with a material such as a pore forming polyvinyl formal reaction mixture that hardens to form a sponge. The pores or open-cells formed in the sponge which are required for the absorbability thereof can be produced in a conventional manner by foaming the original or starting material. It is especially advantageous, however, to employ a material for producing the sponge, that is mixed with a water-soluble filler which is washable or rinsable out of the sponge after the hardening of the latter so as to form the desired porosity, and this is to be simply poured or cast into the annular mold without foaming. Cast or molded sponges that are produced in this manner are able to be formed with especially fine pores.

In accordance with other features of the invention, the endless entrainer for squeezing of dyeing a textile fabric web in a foulard, is coated with a sponge or is formed of an endless textile fabric web covered with sponge. In both cases, the sponge should again be provided with as fine pores as possible, so that preferably cast or molded sponges are used.

In accordance with a further feature of the invention, the entrainer in a foulard for squeezing or dyeing textile fabric webs is formed of an endless textile insert cast or foamed in a sponge formed as an endless web, as well.

In accordance with an added feature of the invention, the entrainer is formed by casting or molding the sponge material which is introduced from below into the annular or ring-shaped mold so that air inclusions cannot arise in the sponge material to be produced.

When the region of the entrainer wherein the endless textile web is embedded has a lower absorption force than the other regions of the sponge material, it is expedient, in the production of the entrainer, to place the endless textile web at the wall of the annular mold before the casting or foaming operation or to cast it or foam it into the outer surface of the sponge which, during use of the produced entrainer, faces away from the working surface thereof. By the "working surface" of the entrainer, there is understood the surface thereof which, when used, comes in contact with the fabric web that is to be squeezed. Depending upon the composition of the material of the entrainer, it can also be advantageous to place the endless textile inlay of the entrainer at the working surface thereof because, among other things, the lastingness or durability of the entrainer can be increased thereby.

The endless inlay or insert of the entrainer of the invention has been referred to as a "textile" web solely in the interest of simplicity. Obviously, the web can also be of non-textile materials, such as glass fibers or metals. The web can furthermore be formed of woven or knitted fabric, though also formed as a foil. What is essential primarily is that the endless inlay in the entrainer provides the necessary mechanical stability. The endless inlay is primarily supposed to prevent the entrainer from tearing during use thereof. The two demands made upon the new entrainers, first of all, namely high absorbability and tensile strength are fulfilled by different components, namely the sponge material and the textile inlay, which are inseparably produced, and especially cast, as a single endless web.

The hardening of the fresh entrainer, for example formed by casting or molding, is generally accomplished at elevated temperature such as 40° C. for example. As a rule, a skin is formed on the entire surface of the sponge or entrainer. This skin is initially expediently removed only at both end surfaces. By "end surface" there is meant the margins or edges of the entrainer that is produced. The sponge is then traversed by a cleansing medium, such as water, for example, for one end surface to the other thereof, especially with the sponge still retained in the annular mold. During this step of washing out the entrainer, chemicals that have not been converted during the hardening thereof, as well as filler material necessary for forming the pores in the sponge are swept away. Consequently, in accordance with another feature of the invention, to form penetrating pores in the cast sponge, a water-soluble filler material, such as a water-soluble cellulose modification, is mixed with the starting material for the sponge, and is able to be washed or rinsed out after the hardening of the sponge material.

After the washing step, to complete the production of the entrainer, it is essentially only necessary yet to remove the skin or surface layer which is formed pore-free or with limited pores during the hardening step, at least from the working surface of the entrainer. In accordance with yet another feature of the invention, this is attainable in a relatively simple manner by drawing the sponge onto a cylindrical surface and then turning down the skin or outer surface layer with the aid of a lathe. In accordance with yet a further feature of the invention, the annular mold is a cylindrical ring having an inner wall and an outer wall coaxial with the inner wall and, after removing the outer cylindrical wall is retained as a support for the sponge as it is being turned down on the lathe.

Other features which are considered as characteristic for the invention are set forth in the appended claims.

Although the invention is illustrated and described herein as embodied in method of producing an endless follower, and product per se, it is nevertheless not intended to be limited to the details shown, since various modifications may be made therein without departing from the spirit of the invention and within the scope and range of equivalents of the claims.

Figure 1B:
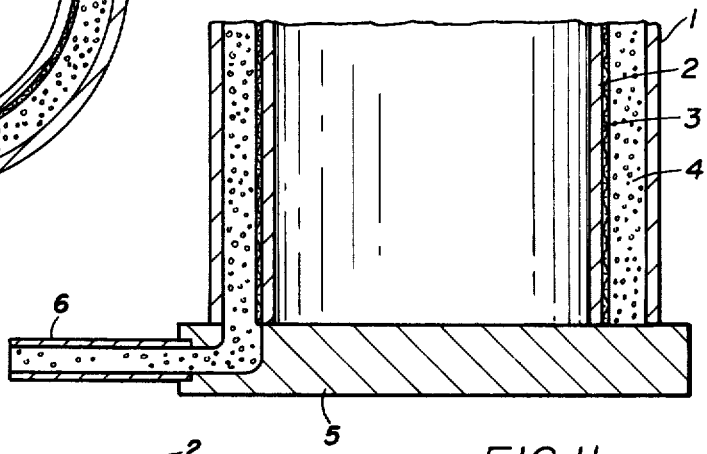
Figure 4:
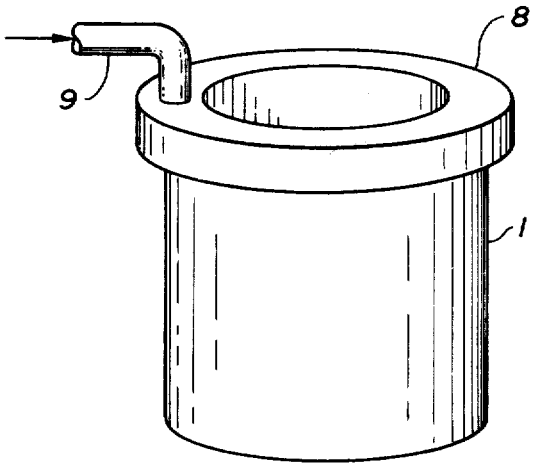
Figure 5:
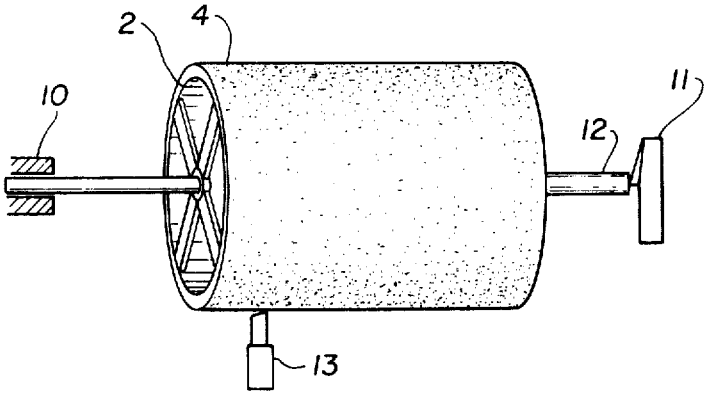
Figure 6:
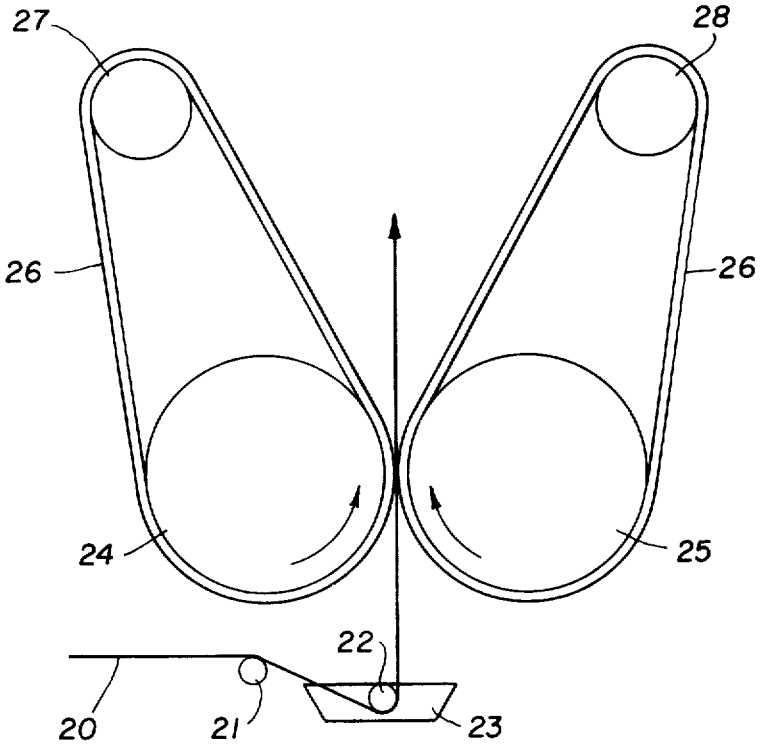

The invention, however, together with additional objects and advantages thereof will be best understood from the following description when read in connection with the accompanying drawings, in which:

FIG. 1*a* is a horizontal cross-sectional view of an annular mold for use in the method of producing an endless follower or entrainer according to the invention;

FIG. 1*b* is a vertical sectional view of FIG. 1*a* taken along the line B—B in the direction of arrows;

FIGS. 2 to 5 are various perspective views of the annular mold or part thereof as employed in different stages of the method of the invention; and FIG. 6 is a diagrammatic view of the apparatus making use of the entrainer per se produced by the method of the invention.

Referring now to the drawing and first, particularly to FIGS. 1*a* and 1*b* thereof, there is shown therein an annular mold employed in the method according to the invention which in the interest of clarity and simplicity, is shown as a cylindrical mold, though may be provided with any other suitable shape in keeping with the invention. FIG. 1*a*, accordingly, is a cross-sectional view perpendicular to the longitudinal axis of the cylindrical mold, while FIG. 1*b* is a longitudinal sectional view taken along the axis of the cylindrical mold. The annular mold is thus formed of an outer cylindrical wall 1 and an inner cylindrical wall 2 diametrically spaced from and coaxial to one another. An endless textile web 3 which, as noted hereinbefore, may be formed of glass fibers or, in fact, may be in the form of a foil of synthetic or other suitable material is disposed on or against or in the immediate vicinity of the inner cylindrical wall 2. Casting or molding of the sponge forming material 4 fills the annular molding space between the coaxially disposed cylindrical walls 1 and 2. As shown in FIG. 1*b*, the cylindrical mold is disposed in upright position and advantageously filled from below with sponge material in order to prevent the formation of air bubbles in the sponge material.

Figure 2:
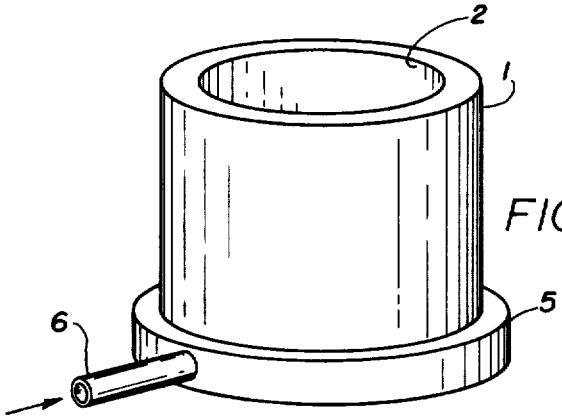

Particularly for the case of an entrainer with molding or casting sponge forming material, there is shown in FIG. 1*b*, as well as in FIG. 2, a cylindrical ring mold 1, 2 and 5 which is seated on an annular or ring-shaped trough 5 through which the cylindrical mold is filled with the sponge forming material 4. As can readily be seen in the sectional view of FIG. 1*b*, the upper opening of the ring trough 5 corresponds in area to and is aligned with the annular bottom opening of the space between the cylindrical walls 1 and 2 so that compressed flowing sponge material can be forced from below upwardly into the space between the cylinder walls 1 and 2 through a filling tube 6 extending into the ring trough 5.

Figure 3:
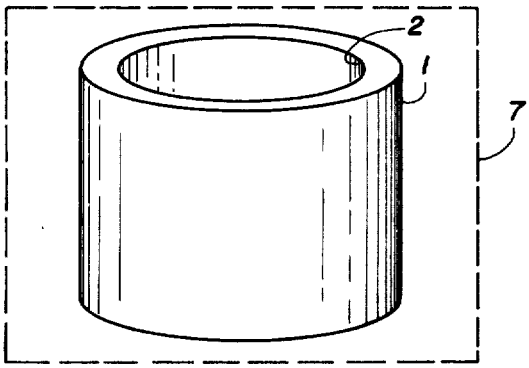

After the cylindrical or ring spaced between the walls 1 and 2 have been filled with the sponge forming material 4, the cylinder mold without the trough 5, i.e., uncovered at both the top and bottom thereof, as shown in FIG. 3, is placed in a diagrammatically illustrated thermal chamber 7 to permit the sponge material to harden therein.

After the hardening process is completed, the resulting sponge generally must yet be cleaned. In that regard, the skin that has formed at the exposed ends of the ring-shaped sponge is first removed by any suitable means, then a ring trough 8 with a filling tube 9, both very similar to the corresponding members shown in FIG. 1*b*, are placed on the cylindrical or ring mold 1, 2 and 5, as shown in FIG. 4. With the aid of the ring trough 8 and the filling tube 9, a rinsing medium, such as water, for example, is fed through the hardened entrainer.

After then removing the outer cylindrical wall 1 of the ring mold, the skin formed by hardening can be removed from the thus cleansed sponge by turning as shown in FIG. 5. For this purpose, the inner cylindrical wall 2 of the ring mold is axially mounted on a shaft 12 clamped between a drive and a tailstock 11 of a lathe, and is turned down by a turning tool. Especially, if the material of the sponge formed as an endless entrainer is, in fact, soft when in moist condition, and hard when in dry condition, such as in the case where it is formed from polyvinyl alcohol, an unusually smooth porous surface is produced upon turning down the sponge in accordance with the procedure shown in FIG. 5.

In FIG. 6, there is shown diagrammatically, an application of the entrainer produced by the method of the invention, a fabric web 20 is passed over guide rollers 21 and 22 through a dyeing bath 23 and is then to be squeezed out in a foulard. The foulard shown in FIG. 6 is formed of two squeeze rollers 24 and 25 over which respective endless followers or entrainers 26, constructed in accordance with the invention, have been placed and stretched or extended by respective idler rollers 27 and 28, the pairs of rollers 24 and 27, on the one hand, and 25 and 28, on the other hand, being mounted on suitably secured non-illustrated shafts spaced apart an adequate distance to maintain tension in the entrainers 26. By using the entrainers 26 of the invention, a squeeze foulard according to FIG. 6 can readily squeeze the moisture out of the dyed fabric web 20 so as readily to leave a moisture remainder of 25% with respect to the dry weight of the introduced fabric web.

Following are representative examples employed to produced the sponge material for the invention of this application.

FIRST EXAMPLE 250 g polyvinyl alcohol, 5 g cellulose, 5 g commercial softener, 1 g finely divided aluminum powder, 75 g formaldehyde, 55 g concentrated hydrochloric acid, and 80 g water, were mixed together. The aluminum powder and hydrochloric acid reacted, freeing hydrogen which formed bubbles in the thus-foamed mixture. The hydrogen ions, formaldehyde and polyvinyl alcohol reacted so as to harden the mixture into a spongy mass.

SECOND EXAMPLE 1200 g polyvinyl alcohol, 325 g formaldehyde, 800 g sulphuric acid, and at least 1200 g sodium chloride were mixed, the sodium chloride being in excess of the amount necessary to enter into the resulting reaction so that a dispersion of sodium chloride within the resulting hardening mixture was formed. Water was then applied to the mixture to wash out the excess sodium chloride, leaving a spongy structure.

The addition of even greater excesses of sodium chloride produced larger pores in the resulting sponge material.

Cellulose added in amounts of 50 to 100 g increased the firmness of the sponge.

In both examples of sponge production, hardening of the spongy material was carried out at atmospheric pressure and at the same temperature. At a temperatue of 30° C, the sponge took 2 days to harden, and at a temperature of 80° C, the sponge was hardened in three hours.

Reference can also be made to U.S. Pat. No. 2,609,347 to Wilson, U.S. Pat. No. 2,668,153 to Hammon and U.S. Pat. No. 2,825,747 to Lewiston and Stevens, for other suitable processes for forming the sponge that is employed with the method of the invention.

I claim:

1. Method of producing an entrainer for squeezing or dyeing textile fabric webs with the aid of a foulard which comprises inserting a spread-out endless textile web into an annular mold having an annular space bounded by an outer wall having a continuous surface and an inner wall having a continuous surface with said spread-out endless textile web disposed on said inner wall having a continuous surface, both the web and the annular mold having a periphery and a width corresponding to the periphery and width of the entrainer to be formed and thereafter filling the annular mold with a material that hardens to form a sponge to produce an entrainer having an endless textile web inlaid with an endless sponge web with the sides of said entrainer adjacent said walls having continuous surfaces, and with the surface of said sponge web being free of seams and joints, permiting said material to harden in said mold; removing the skins at both end surfaces of the hardened annular sponge; passing a cleansing medium through the sponge from one end surface to the other end surface to wash out unreacted materials; and removing the outer surface skin from said cleansed product to form said entrainer.

2. Method according to claim 1 wherein the material being hardened into a sponge is formed with a skin over the entire surface thereof, and which includes first removing the skin at both end surfaces of the annular hardened sponge, and then passing a flow of cleansing medium from one end surface to the other of the annular sponge.

3. Method according to claim 1 wherein said annular mold is cylindrical ring having an inner and an outer removable coaxial wall, and wherein said outer wall is removed and said inner wall is retained as a support for the cylindrical sponge, and said cylindrical sponge supported by said inner wall turned on a lathe and the skin formed on the cylindrical surface of said cylindrical sponge is turned down with the aid of the lathe.

4. Endless entrainer adapted for squeezing or dyeing textile fabric webs with the aid of a foulard which entrainer is prepared according to the method of claim 1.

* * * * *